United States Patent [19]

Burau et al.

[11] Patent Number: 5,018,569

[45] Date of Patent: May 28, 1991

[54] METHOD FOR CONTINUOUS CASTING OF THIN SLAB INGOTS

[75] Inventors: Armin Burau, Muelheim; Hans-Georg Eberhardt, Duisburg; Hans J. Ehrenberg, Duesseldorf; Hans U. Franzen; Rainer Lenk, both Duisburg; Lothar Parschat, Ratingen; Manfred Pfluger; Fritz-Peter Pleschiutschnigg, both of Duisburg; Werner Rahmfeld, Muelheim, all of Fed. Rep. of Germany

[73] Assignee: Mannesmann AG, Duesseldorf, Fed. Rep. of Germany

[21] Appl. No.: 374,444

[22] Filed: Jun. 30, 1989

[30] Foreign Application Priority Data

Jul. 4, 1988 [DE] Fed. Rep. of Germany ..... 3822939
Mar. 8, 1989 [DE] Fed. Rep. of Germany ..... 3907905

[51] Int. Cl.[5] ..... B22D 11/20; B22D 11/16

[52] U.S. Cl. ..... 164/454; 164/413; 164/477; 164/451

[58] Field of Search ..... 164/451, 452, 454, 476, 164/477, 413, 417

[56] References Cited

U.S. PATENT DOCUMENTS

| | | | |
|---|---|---|---|
| 3,358,743 | 12/1967 | Adams | 164/449 |
| 4,148,349 | 4/1979 | Sumita et al. | 164/452 |

FOREIGN PATENT DOCUMENTS

| | | | |
|---|---|---|---|
| 269493 | 6/1988 | European Pat. Off. | 164/154 |
| 2444443 | 3/1975 | Fed. Rep. of Germany | 164/154 |
| 55-133855 | 10/1980 | Japan | 164/154 |
| 58-184052 | 10/1983 | Japan | 164/154 |
| 63-242452 | 10/1988 | Japan | 164/452 |
| 685420 | 9/1979 | U.S.S.R. | 164/154 |

*Primary Examiner*—Richard K. Seidel
*Assistant Examiner*—Rex E. Pelto
*Attorney, Agent, or Firm*—Ralf H. Siegemund

[57] ABSTRACT

A method for continuous casting of thin slab ingots with reduced thickness following immediately the casting particularly of steel under utilization of a mold which is open at the bottom and under further utilization of roller pairs arranged along the withdrawal path, at least some of them are driven and at least some of the rollers are hydraulically adjustable perpendicular from the path so as to act as ingot deforming rolls. The invention is further improved by determining the speed of driven rollers, and the pressure force of adjustable roller pairs acting against the ingot and providing feedback control for the speed and the force. Additionally, providing a master control action for the speed control such that a point of solidification is dynamically maintained in a particular geometric position as far as the passing ingot is concerned; and by limiting the adjustment of rollers as far as the gap between pairs of such rollers is concerned downstream from that point.

3 Claims, 3 Drawing Sheets

METHOD FOR CONTINUOUS CASTING OF THIN SLAB INGOTS

BACKGROUND OF THE INVENTION

The present invention relates to continuous casting for the production of relatively thin slab ingots, wherein the relatively reduced thickness obtains downstream from the mold and as compared with the state during casting, particularly for the casting of steel. Steel is poured into the mold and is withdrawn by means of rollers engaging accordingly the partially solidified casting or ingot and acting as rolls for reducing its thickness. At least some of the rolls are driven while at least individual ones of the rolls or rollers of any pair of oppositely positioned rolls are adjustable hydraulically vis-a-vis each other and the ingot in between as it is being withdrawn.

Slabs are usually the raw materials or blanks for the production of sheet stock, or plate and strip material. If the slabs being continuously cast have a thickness in excess of 100 mm certain internal separation problems arise inside the casting. In accordance with German printed patent application No. 24 44 443 the problem of separation was solved by deforming the ingot just a little upstream from the (internal) point in the casting wherein solidification was completed. The reduction in cross section or at least on one dimension in this situation is to be about 1/10% or more but not more than about 2%.

Presently developments in the field of continuous casting have led to attempts to match the thickness of the ingot made by continuous casting as close as possible to the thickness of the desired final product. Basically particularly thin slabs are the result of these efforts. A thin slab is e.g. a strip blank with a thickness of about 40 to 50 mm. Strips or slab blanks of that kind however have a casting texture of a particular kind. Following the withdrawal of the ingot by the transport rollers the solidified strand or ingot is cut into certain lengths, and the resulting individual thin slab pieces are fed to an equalizing furnace in order to make sure that the temperature is the same throughout; following which the slab is rolled. This procedure is described in "Stahl und Eisen" (Steel and Iron), 1988, vol. 3, page 99 et seq. This method is quite conventional but disadvantaged by the fact that the plant and machinery is rather complex. Moreover, the casting texture of the slab is undesirable.

DESCRIPTION OF THE INVENTION

It is an object of the present invention to provide a new and improved method for continuous casting of thin slabs wherein the internal texture of the solidifying ingot is not so much that attributable to casting but is already to 80% or even more a rolling texture. Moreover, the product leaving the casting machine should already be amenable to coiling.

It is therefore a specific object of the present invention to provide a new and improved method for continuous casting of thin slabs of steel under utilization of a mold and with a withdrawal path in which withdrawal rollers are used as rolls for purposes of reducing the thickness of the casting.

In accordance with a specific object of the present invention the invention is particularly an improvement of a continuous casting machine and method for the production of slab ingots with reduced thickness using individual driven rolls and segmentizing or grouping the rolls in the withdrawal path. Some of the rolls, individually or in groups are hydraulically adjustable to provide a reduced gap for purposes of controlling the deforming of the ingot. The hydraulic pressure is basically responsible for obtaining a specific degree of deformation of a given casting but spacers may limit the degree of advance of rollers towards the ingot and thereby reduce limit force or deformation exerted on the ingot.

In accordance with the preferred embodiment of the present invention it is suggested that each roll that is driven is speed controlled and rolls that are adjustable in relation to the withdrawal path are controlled as to the pressure force exerted on the ingot; further included is a master controlling action for at least some of the individual controllers as associated with individual rolls such that the position of the point of complete solidification which as far as the internal casting is concerned is the location of the end of the liquid sump remains stationary via the casting machine. This master controller affects the individual roll pairs as well as the ingot speed such that the solidification point is situated in or upstream from the farthest upstream roller pair whose distance from each other is limited by means of stops or spaces in a particular fashion and which, therefore, determine the final thickness of the ingot that is being cast. The withdrawal speed of the casting as well as the degree of deformation in the completely solidified zone are additional control parameters.

The particular position of the point of complete solidification is an empirical fact. It can be ascertained from different speeds among roll pairs. This is so since the speed of the casting is different as between the portion that is solidifying and the portion that has already solidified owing to the roll action. Thereby all rolls should run at the same speed upstream from the point of complete solidifcation even if thickness reduction takes place. Another indicator is the electric currents of the drives of respective two adjacent roller pairs. The reaction forces against deformation of the casting is still another parameter. The reaction forces of the casting against the rollers can be ascertained from the differences between the deformation force on one hand and the force derived from the deforming work through the adjustment of the rollers. The deformation proper is e.g. measured by measuring the pressure of the hydraulic medium which exerts adjusting force on the rollers or one may apply a pressure transducer for the rollers.

The master controller will in furtherance receive input data concerning particulars of the casting machine and equipment; other data include information on the work such as steel temperature; still further parameters define the steel quality and its physical properties; also of interest is the withdrawal speed of the casting and the disposition of the rollers on the basis of the gap between the rolls of a pair. These data are selectively inputted for the formation of reference values by the master controller for use in the individual controllers.

The inventive control method has the advantage that basically the casting deformation is subdivided, free from basic constraints, to separately affect the solidifying zone and the solidified zone of the casting. The control renders the point of separation dynamically-stationarily invariant. The ensuing deformation is matched to the quality and the load on the rolls causing the deformation is reduced. Of primary importance is the production of a high grade product with a high degree of internal rolling type texture which is the main object and purpose of the invention. The texture improvement provides in turn an improvement in the mechanical properties of the final product as compared with conventional manufacturing methods.

In practicing the invention one proceeds e.g. in that the speed of any individual roller is either lowered or increased until the electric current for the respective drive of all of these drives is the same. The master controller provides for this equalization which e.g. receives as an input the motor current for all roll driving motors, sums them and establishes the average value which in turn is fed back for purposes of control of individual drives. Deviations of motor currents in any individual case from the average value is ascertained and compensated through individual correction of the speed reference value in each individual controller.

In the case certain rollers are limited through abutments it is conceivable that a particular roller or roll is stopped and has insufficient contact with the ingot. This means that the particular roller runs up to a limit speed value but does not actually participate in the transportation. In order to make sure that each roller has in fact engagement and contact with the slab it is suggested to correct the speed of the rollers on the basis of an average value which average value is formed from the speed of the first and third rolls of a group of three being arranged in immediate sequence along the withdrawal path. The speed of the middle one i.e. the second roll will be controlled within a given tolerance range to assume exactly the average value whereby the tolerance range does not exceed the difference in speed between the first and the third roller.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
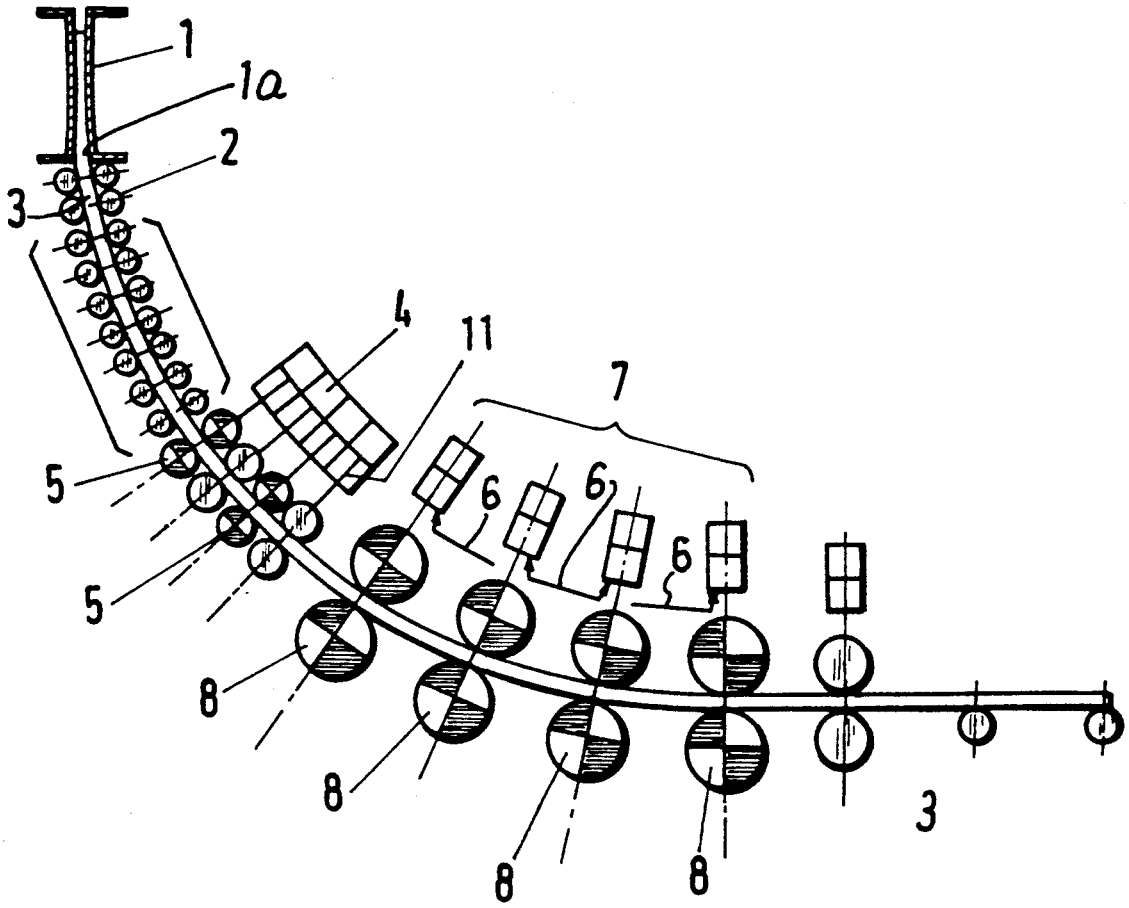
FIG. 1 illustrates a basic configuration of a continuous casting machine with combined rolling and withdrawal equipment, the figure is serving primarily for the introduction of terms and reference aspects.

Proceeding now to the detailed description of the drawings, reference is first made to FIG. 1 showing somewhat schematically a mold 1 for casting a slab ingot having initially about 60 mm thickness. This thickness is basically given and determined by the distance between the wide or broad walls of the mold. The mold 1 has an open bottom 1*a*, and plural rollers are arranged downstream from that opening. These rollers act as rolls and reduce the ingot thickness.

Rollers 2 are arranged in pairs, and they are disposed immediately underneath and downstream from the opening 1*a*. They provide the initial substantial support of the casting ingot 3 as it leaves the mold 1 having at that point a solidified skin which is quite thin. These rollers 2 do not do anything else except guiding the casting from the mold into the withdrawal path.

Further rollers are arranged downstream from the rollers 2. These rollers 5 are combined in a section or segment 4. Individual rolls and rollers 5 are driven, some are not. Each roll, individual ones or all as a group (4) are adjustable through hydraulic cylinder 11 to be moved towards or away from the casting 3. The hydraulic adjustment of the rollers 5 towards each other within each individual pair, controls the gap width of the withdrawal path and, therefore, controls any deformation and any degree of deformation these rolls 5 provide on the casting 3.

It is now assumed and the entire device is preplanned in such a fashion that at some point within the segment 4 complete solidification of the metal obtains within the casting 3 giving rise to the position of a sump peak. That peak is a point or zone that should remain position invariant, but dynamically so if it is more or less stationary in the withdrawal path as the ingot 3 progresses. This segment 4 therefore defines and maintains and is provided for maintaining a point (14) of solidification at the casting.

Downstream from segment 4 is a segment or section 7 having a plurality of larger rolls 8, all of them being driven. The rolls 8 are also adjustable individually through hydraulics to thereby adjust the roller path, width and gap. Furthermore, all of the rolls e.g. on any one side are limited through abutment and stops 6 so that in pairs they do not exceed a specific width reduction offered for the casting 3. These stops therefore provide a definite maximal dimensional thickness reduction of a casting, resulting in a definite final thickness of that casting as it leads to the withdrawal path. The last pair of rolls 8 may not be driven but is adjustable as to that final thickness value for the casting.

Owing to the deformation of the solidified casting the speeds of the rolls vary from roll to roll corresponding to the dimensional change. Since the rolls may vary in terms of spacing e.g. from 20 to 15 mm distance one needs a wide range of speed control for individual ones of three rolls and rollers. The speed of the rolls can be measured directly or may indirectly be ascertained through the current input to the respective drive for the roll under further consideration of the hydraulic pressure and the spacing between the rolls or rollers. In order to obtain an adequate control, a circuit is used of the kind shown in FIG. 2.

The casting 3 emerging from the mold 1 and as it is passed on by the roller pairs 2 (not shown in FIG. 2) continue into group 4. The rolls of that group were collectively designated in FIG. 1 by numeral 5, but are now more detailed as to designation in FIG. 2. A roll 9 here has its journal mount adjusted through a piston cylinder drive 11. This particular piston cylinder drive 11 is associated with and controlled by a controller 10 which therefore is associated with the particular roll 9, or one can say that it is associated with the roller pair 9—9' as far as the gap width between the two rollers 9 and 9' is concerned.

The controller 10 has an input the output of a transducer 11*a* which will measure the pressure of the hydraulic medium compared with a particular reference value furnished along a line 20*a* through which a common reference signal is provided for this controller 10 and others (infra) by a master controller 20. Controller 10 causes a control valve mechanism to adjust the pressure distribution on both sides of the piston cylinder drive 11. This adjustment adjusts the pressure as it is effective between the two rolls 9 and 9' to act on the ingot 3.

Strictly speaking, the hydraulic position adjustment of any of the rolls, here 9, is equivalent dynamically with adjustment of both rolls, 9 and 9', or with just 9' as the adjustment is relative between the rolls of a pair and both rolls which exert force onto the ingot irrespective as to which one is adjusted, as long as both rolls do engage the ingot!

Another controller 10' receives the output of a transducer 21 representing the actual speed of the roll 9' as well as a reference signal from a common line **20*b* to control the speed 4 of that roll 9'. Owing to frictional/-pressure engagement, speed control of one roll, such as 9', amounts to a speed control of both rolls 9 and 9' and again it makes no difference in principle which one of the rolls, 9 or 9' is actually driven. From a practical point of view one of the rolls is adjusted by drastically (e.g. 9) the other one (e.g. 9'**) is driven and directly speed controlled.

The deformation of the casting 3 within the zone of action of the rolls 2 and 2' is controllable through the adjustment of the hydraulic pressure in piston cylinder drive 11 and thus through the relative disposition of the two rollers 9 and 9' in relation to each other as controlled by that hydraulic positioning drive 11. The deformation is a positive one, i.e. it is assumed that the casting 3 will leave the two pairs 9 and 9' in a width reduced fashion. The reduction is an adjustable one in accordance with the control as exerted by the elements as described.

Following the initial deformation, casting and ingot 3 reaches other pairs of rolls such as identified by reference numerals 12 and 12' and also pertaining to the group 4 of rollers (5) as shown in FIG. 1. This pair of rolls 12 and 12' is also arranged and provided in that the roll 5 is stationary but speed controlled (13') while the roll 12 has its journal mount adjusted by a piston cylinder 11 which is of the same kind mentioned above. This drive 11 here is under control of a controller 13 acting analogously to the controller 10 as described earlier. Still analogously the controller 13' provides a comparison of the common speed reference with a speed signal extracted from the roller 12'.

The rollers 9, 9', 12 and 12' are representative for those which are situated in the solidification path, that means upstream from the point 14' of complete solidification. It is for this reason that all these rolls will in fact be driven with uniform speed which is equivalent to the casting speed.

Downstream from the point 14 of solidification are situated other roller pairs being representative of rollers 8 and pertaining to group 7. Here the deformation obtains already in a completely solidifed strand or ingot. Accordingly the exerted deformation work is considerably higher and is ascertained here through a path transducer 16 which provides in this case one of the inputs to the hydraulic drive (11) and its controller 17. This controller receives also a reference value from line **20*a* and will provide a control input for the particular hydraulic drive 11 of roll 15, the relevant data here is a a pressure value which is directly related to the requisite deformation work provided by roll 15** upon the solidified ingot.

Owing to the fact that here now a solid is being worked because the ingot is assumed to be completely solidified, the resulting deformation by the rolls 15—15' results in a stretching of the ingot which means that e.g. a downstream roller pair 18, 18' will have to run at a higher speed simply because the speed of the ingot 3 when in the range of these rollers 18 and 18' is larger than ingot speed in the range of rollers 15 and 15'.

It is assumed moreover that the particular rolls 18 and 18' are the last ones of the work exerting rolls so that they determine the final thickness of the strand, casting and ingot 3. The final thickness is ultimately determined through the control of the disposition of the rollers or rolls 18 by operation of its particular hydraulic drive 11 that positions the roll 18 and the position of that roll in turn is the result of control action by a controller 19. In addition, spacer pieces 6 may be provided to avoid that the ingot 3 will be too thin. A controller 19' is provided to control the rotational speed for the roll 18' and again in that regard roll 18 is an idler that follows the rotation.

All controllers such as 10, 10', 13, 13' etc. are under control of a master controller 20. The controller 20 processes all relevant data related to the particular casting such as the composition of the steel, its temperature, the casting speed as well as all ingot data which the individual controllers receive from their specific locations. Roll speed, local pressure on the ingot, current consumed by the drive etc.

Figure 2:
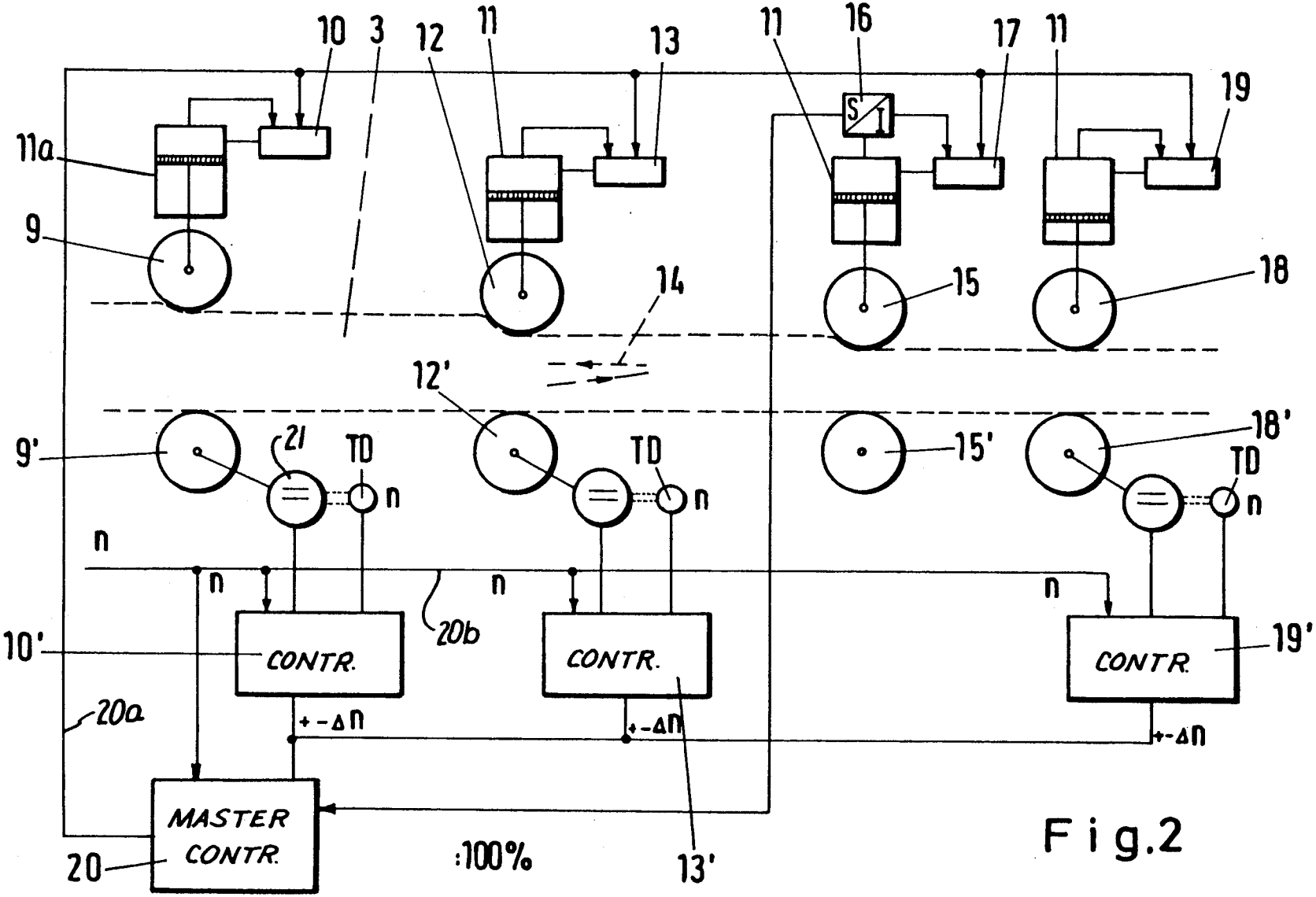
FIG. 2 is a diagram for the arrangement in accordance with the preferred embodiment of the present invention for practicing the best mode thereof.

All the aforementioned data are processed in the controller 20, ultimately to determine the reference values for all these other controllers on the basis of the existing data. In other words, average operations and common phenomena are taken into account to match the operation of all these controllers to each other. In FIG. 2 it is assumed that master control 20 receives also a basic speed reference that represents the casting speed; (line **20*b*) and controller 20 then provides a corrective speed delta n that takes additional but common aspects into consideration. Controller 20 furnishes also the hydraulic pressure reference, line 20*a***.

Ultimately of course on the basis of reference data which are common to all of the controllers the casting speed is determined which, so to speak, is the primary speed input for the casting 3 and all other downstream speeds resulting from changes in the length dimension of the casting are then slaved to that principle speed value. Also the steel composition determines ultimately in conjunction with temperature the work that has to be exerted to obtain a specific deformation and that gives rise to the signal in line 20.

The various reference values thus provided by the controller 20 and fed to the individual controllers are locally modified in order to obtain for a given final dimension of the strand in a rather uniform distribution of the overall deformation work over the various rolls. FIG. 2 shows only a few rollers or rolls in the transport path but from FIG. 1 it can be seen that there is a fairly large number of such rollers and the deformation work should be carried out by all of them, to minimize for a given state of overall deformation the load on each individual roll or roller. In addition of course controller 20 determines the speed as stated in relation to the path length for the solidification. This is ultimately of importance since dynamically the point 14 is to be maintained in a particular range of the transport and deformation path.

All these efforts lead towards a production of casting which has, relatively speaking, a very high degree in rolling texture and very little casting texture. The control as described moreover permits the adjustment of the work within each individual guide path rolls but under cooperation with abutment and stops. The deformation work is to be distributed more or less equally. Another distribution factor for the deformation work is the part of the deformation obtained in the solidified and other deformation provided on the partially solidified strand.

Depending on the particular operation the final ingot thickness may be obtained already with one or even the first one of the roller pairs of group 7. Looking in the withdrawal direction the other downstream roller pairs of group 7 will then be controlled towards equal rotational speed and their portion is to maintain that final dimension. If on account for some reason a higher deformation resistance of the ingot is observed e.g. the temperature has dropped more than foreseen, then the deformation work may have to be distributed over more than one roll so that not just the first one of group 7 but one more or even several following thereafter of the roll pairs will together work towards attaining the final thickness dimension of the slab ingot in order to avoid undue load on the first roller pair. If the principal thickness dimension determining roller pair is not the first one of group 7, then upstream rolls from that downstream most thickness determining rolls must not work against abutments but so to speak "float" dynamically as far as the withdrawal path gap and spacing is concerned, on account of the regulation and control as described.

Figure 3:
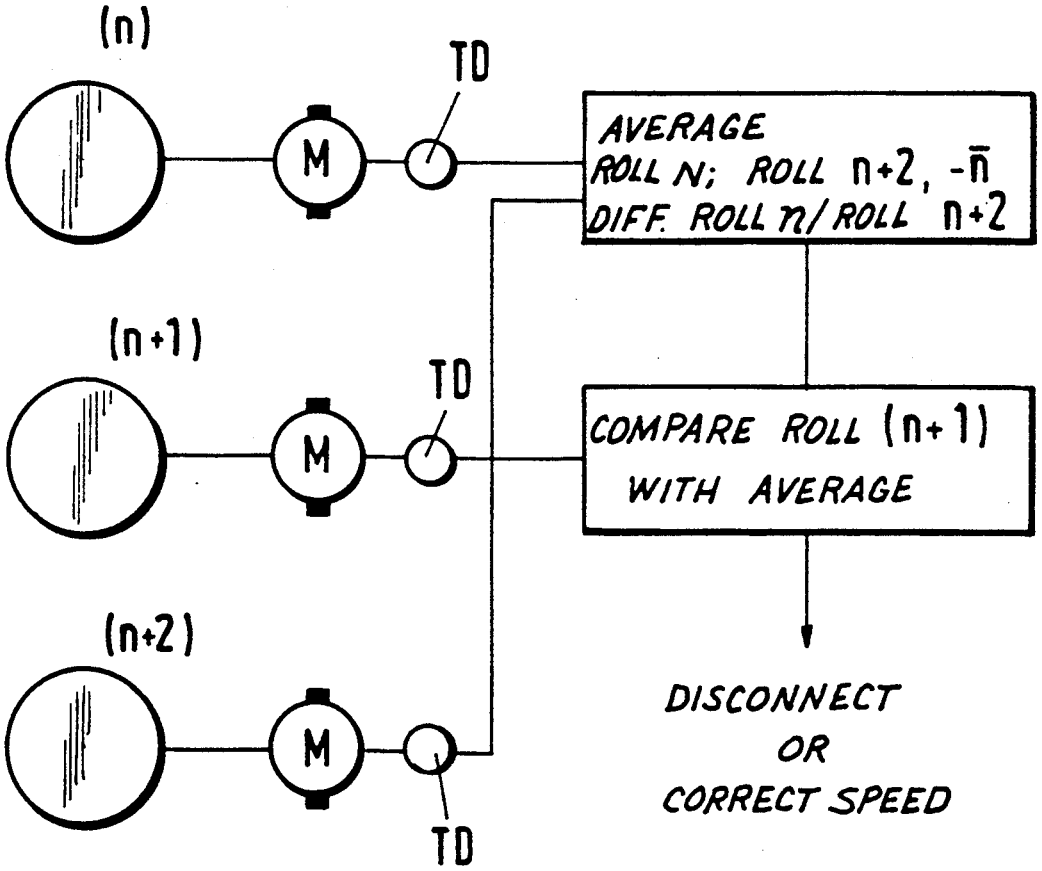
FIG. 3 is a schematic showing of a refinement of the control arrangement in accordance with FIG. 2.

FIG. 3 illustrates a modification of the inventive system showing a refinement of the inventive method particularly under utilization of averaging signal values. FIG. 2 was used primarily in order to explain operation and function of different roll groups along the withdrawal path. FIG. 3 now takes into consideration that each group of rollers such as 4 and 7 includes multiple rolls so that the ascertainment of average values is a meaningful undertaking. Averaging has the advantage that in effect slippage of any particular driven roll in respect to the strand and casting can be avoided, and the roll or roller is, through a feedback control, maintained in a particular abutting relation that is determined by the purpose or a particular purpose of casting the system is in a position to offset permanent deviations and tolerances of the diameter of a particular roller vis-a-vis the others so that control obtains correctly in relation to the particular order.

Consider the FIG. 3 to depict the three rollers n, n+1 and n+2; they are just three of a series of rolls or rollers along the withdrawal path. They constitute a subgroup of three individually driven rolls that may pertain to group 4 or to group 7. Driving is provided by electric motors M. These motors each carry on their respective shaft a tachometer TD to give off a signal representative of the respective motor and speed. For the particular concept underlying the inventive control, a particular roll or roller which is not in contact with the ingot and has relative slippage, it may run at top speeds which is of course faster than the ingot speed. That by and in itself may not pose much of a problem. However if for any reason a roll does contact the ingot it may run at top speed when engaging the slower ingot. The slippage roll may cause in this case surface damage of the casting, particularly if that roll temporarily engages and disengages from the slab ingot. The slab may have slowed down and even stopped while the first running roll when reengaging the slab may be unduly accelerated simply on accidental contact or recontact making with the strand or casting and that in turn may have the effect of pulling unduly on the strand and rupture may be the consequence.

Now one looks at the speeds of the three rollers forming a group of three as stated, then the middle roll can, depending on the deformation, achieve either the speed of the roll upstream or the roll downstream. The speed of the middle roller n+1 assuming to be in contact with the slab ingot, cannot possibly in principle be faster than the speed of the downstream one nor slower than the upstream one of this group of three. A roll which for some reason is blocked will immediately run up to the limit of the current value and therefore this particular situation can be ascertained and signalled as an interference case or a full situation. The slippage or slipping roll on the other hand will be recognized from the individual controller as a nonparticipating roll as far as transportation of the ingot is concerned.

If the speed of the middle roller is larger then the speed of the downstream roller in this group of three, then the situation is such that it must have disengaged from the ingot and slips, otherwise that situation is simply not possible. A slipping-roll or roller is thus recognized through speed comparison and that fact will be signalled as having resulted in or from interference. Conceivably and through operation of the controller it is possible simply to cause the middle roller to run at the medium speed of this particular group of three. Once this has been achieved as indicated by the tachometer then it is permisisble to cause the middle roller to reengage the slab so as to participate again in the ingot transportation.

The adjustment of the roller and the particular adjustment of the spacing between rollers across the withdrawal path is carried out as stated through hydraulic drives 11. The requisite pressure will be produced in a pressure controlled hydraulic station. Maximum pressure is determined by the particular machine equipment. As mentioned above at least for some hydraulic drive 11 it is necessary to include a path measurement 16 in order to ascertain the work that is performed. Only if path measurement is taking place is it possible to recognize clamping or other defects in the roll mount adjustment. The roll position adjustment when carried out strictly in path dependency and through servo valves of the controller 17 and others operates in that the displacement path is the measured input value for the feedback control to be compared with the reference values for completion of the control circuit (17).

It can thus be seen that the drive control for each driven roll or roller is carried out through a controller that is subject to speed control. Those controllers are under control of the master controller 20.

In the past, master controllers were provided to eliminate minor interferences. For this an average is formed from the sum of the motor currents of the several drives. Deviations of the current in the respective motor driving a particular roll, from the medium or average value is used as a corrective value supplementing the particular reference value in that instance and for that particular individual controller. This way one eliminates variations such as different roller diameters and other more or less permanent interferences resulting simply from differences in equipment on one hand to be effective as deviation from the average when in fact there is a common purpose namely the control movement of the particular slab ingot.

In the case of a slab ingot that is very thin as presently envisioned, a significant deformation of the solidifying core has already obtained by roll group 4 then the master controller 20 will in fact be required to cover a fairly large range of corrective values. For this then each task is used to establish a corrective value to be used next. The correction of speed depends on the difference of the individual currents from the average value and that may result in a fairly large corrective value. Then in the case of a slipping roll that is not in contact with the ingot its control has to be shifted into a limit value situation. It was outlined above how slippage can be ascertained and this is of course the idea.

The invention is not limited to the embodiments described above but all changes and modifications thereof, not constituting departures from the spirit and scope of the invention, are intended to be included.

We claim:

1. Method for continuous casting of thin slab ingots with reduced thickness following immediately the casting particularly of steel under utilization of a mold which is open at its bottom and under further utilization of roller pairs arranged along the withdrawal path, at least some of them are driven and at least some of the rollers are hydraulically adjustable perpendicular to the longitudinal direction of the casting so as to act as ingot deforming rolls, the improvement comprising:

determining the instantaneous speed of each separately driven rollers pair; determining the compressive force of each perpendicularly adjustable roller acting against the ingot, and providing a feedback control for adjusting the instantaneous speed and the compressive force of each roller, also separately;

ascertaining the location of a point of complete solidification by detecting the electric current inputted into each individual drive, by detecting the reaction forces produced by the ingot upon the perpendicularly adjustable rollers, and by detecting the spacing of each roller with respect to the oppositely positioned roller, and generating control signals accordingly;

providing a master control action by utilizing each of the control signals, controlling for the speed of each driven roller such that the point of complete solidification is dynamically maintained in a particular geometric position as far as the passing ingot is concerned; and additionally limiting the adjustment of rollers by means of stops as far as the gap between pairs of such rollers is concerned downstream from said point.

2. The improvement as in claim 1, the master controller providing reference values for the speed control.

3. The improvement as in claim 1, providing a speed control for a roller that is an average of an upstream and a downstream roller within a tolerance range smaller than the speed differential of the upstream and downstream roller.

* * * * *